United States Patent [19]

Mascia et al.

[11] 4,341,330

[45] Jul. 27, 1982

[54] AEROSOL CONTAINER

[75] Inventors: Carmen T. Mascia, Clarendon Hills; Gary K. Hasegawa, Chicago, both of Ill.

[73] Assignee: The Continental Group, Inc., New York, N.Y.

[21] Appl. No.: 949,304

[22] Filed: Oct. 6, 1978

[51] Int. Cl.[3] ..... B65D 83/14

[52] U.S. Cl. ..... 222/401; 222/402.1

[58] Field of Search ..... 222/147, 207, 209, 394, 222/348, 396, 401, 400.8, 402, 402.1, 402.11, 402.13, 402.2, 402.21, 402.22, 402.25, 149, 496; 239/390, 337, 324, 362, 363, 373; 417/305; 137/497, 614.19; 251/321-323

[56] References Cited

U.S. PATENT DOCUMENTS

| | | | |
|---|---|---|---|
| 1,550,362 | 8/1925 | Janer | 239/373 |
| 3,224,645 | 12/1965 | Frost | 222/402.13 |
| 3,270,924 | 9/1966 | Kitabayaski | 222/402.1 |
| 3,666,148 | 5/1972 | Webster | 222/402.22 |
| 3,704,813 | 12/1972 | Devol | 222/147 |
| 3,955,720 | 5/1976 | Malone | 222/401 |
| 4,047,645 | 9/1977 | Caliendo | 222/398 |

FOREIGN PATENT DOCUMENTS

| | | | |
|---|---|---|---|
| 560349 | 4/1957 | Italy | 239/363 |

*Primary Examiner*—H. Grant Skaggs
*Attorney, Agent, or Firm*—Charles E. Brown

[57] ABSTRACT

An aerosol container in the form of a conventional type of aerosol can wherein the lower part of the body is provided with external threads with which internal threads of a cup-shaped pump member are engaged so as to define, in conjunction with the lower closure unit, a pump chamber. Suitable inlet check valves are carried by the lower closure unit and a bottom wall of the pump chamber so that air under pressure may be forced into the can internally to pressurize the can. A dispening valve unit is also provided which includes a shutoff valve for preventing dispensing of the product when the pressure within the can goes below a predetermined level.

5 Claims, 5 Drawing Figures

FIG.1
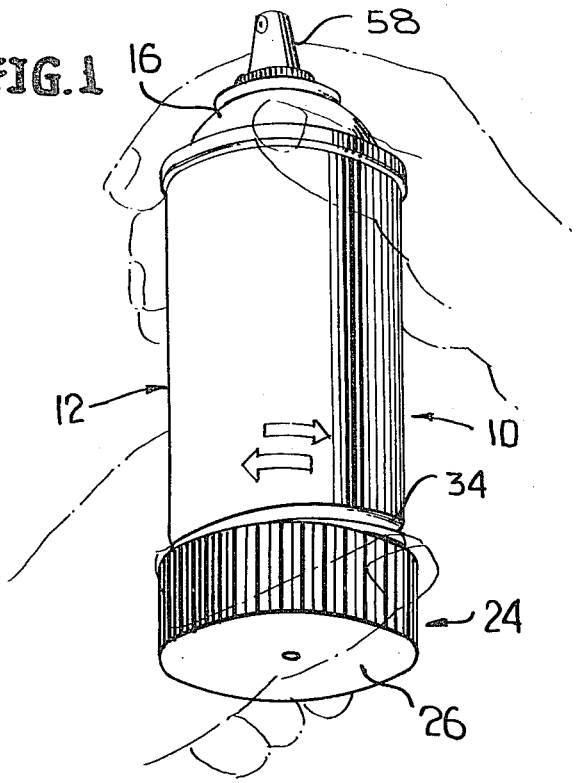
FIG.2
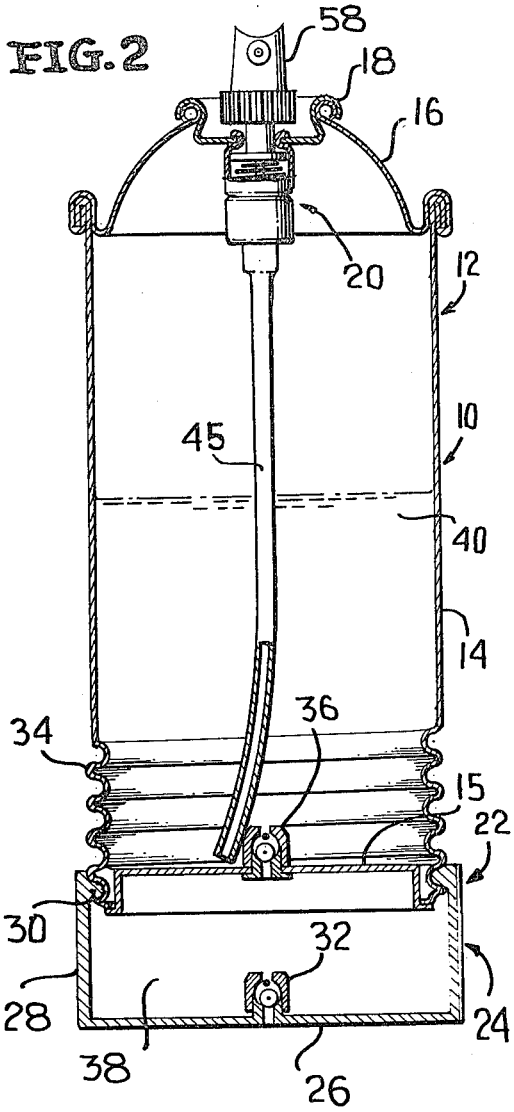
FIG.5
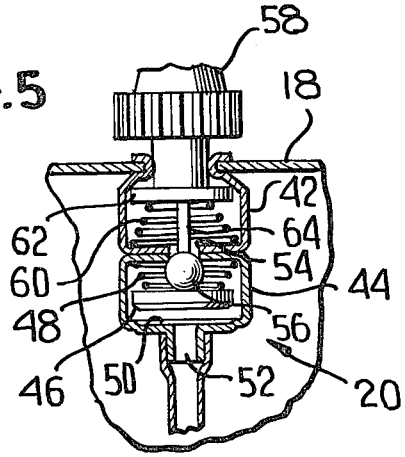
FIG.3
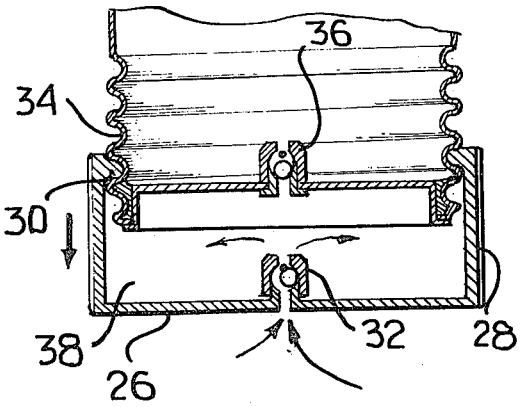
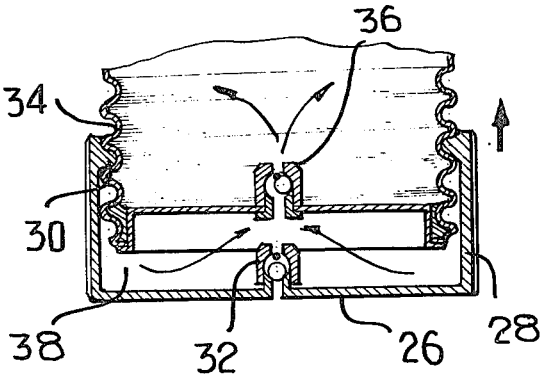
FIG.4

AEROSOL CONTAINER

This invention relates in general to new and useful improvements in aerosol containers, and more particularly to an aerosol container which is free of a charged propellant and wherein pump means are provided for internally pressurizing the container.

In accordance with this invention, it is proposed to provide a conventional aerosol type container with a pump unit which is formed as a part thereof and which, when actuated, serves to pump air into the container so as to pressurize the product stored therein for dispensing.

The pump unit formed in accordance with this invention is generally cup shaped and includes a cylindrical body with internal threads. The lower part of the container body is provided with external threads so that the pump unit may be threaded onto the lower part of the aerosol container and form with the lower closure unit a chamber. The chamber is provided with an inlet valve carried by the pump unit and an outlet valve (inlet into the container) carried by the lower closure unit. By rotating the pump unit, air within the chamber is forced into the container so as to pressurize the container. When the pump unit is unscrewed, the chamber is enlarged and air is drawn into the chamber from the exterior.

Another feature of the invention is the provision of a dispensing unit which includes a dispensing valve and a shutoff valve for shutting off product flow to the dispensing valve when the pressure within the container is below a predetermined pressure, which predetermined pressure assures proper dispensing of the product.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is a perspective view of the aerosol container in the process of being actuated to increase the internal pressure.

FIG. 2 is a longitudinal vertical sectional view taken through the aerosol container of FIG. 1, and shows the specific details thereof.

FIG. 3 is a schematic view showing the pump unit being retracted and air flow thereinto.

FIG. 4 is a schematic view similar to FIG. 3, and shows the pump unit being actuated with air flow being into the interior of the container.

FIG. 5 is an enlarged fragmentary vertical sectional view taken through the dispensing valve mechanism.

Referring now to the drawings in detail, it will be seen that there is illustrated most specifically in FIGS. 1 and 2 an aerosol container formed in accordance with this invention, the aerosol container being generally identified by the numeral 10. The aerosol container 10 includes a can, generally identified by the numeral 12. The can 12, with a certain exception, may be of a conventional aerosol can construction.

Most specifically, as shown in FIG. 2, the can 12 includes a body 14 which has the lower end thereof closed by a lower closure unit 15. The upper end of the body 14 is closed by a conventional upper closure unit 16 which carries a valve cup 18.

The valve cup 18 carries a dispensing valve mechanism, generally identified by the numeral 20, for dispensing a product stored within the can 12 under pressure. At the lower end of the can 12 is a pump unit, generally identified by the numeral 22. These two features constitute the improvements of this invention.

Consideration is first given to the pump unit 22 which includes a pump member 24 which is of a generally cup-shaped configuration and includes a bottom wall 26 and a cylindrical body 28. The cylindrical body 28 is provided with internal threads 30. The bottom wall 26 has carried thereby on the interior of the pump member 24 an inlet check valve 32 of a conventional type which permits air freely to enter the pump member 24 when required, while, at the same time, automatically closing to prevent the exit of air from the pump chamber 24.

The lower part of the can body 14 is provided with external threads 34 which mate with the internal threads 30. In the illustrated embodiment of the invention, the external threads 34 are integrally formed with the can body 14 by suitably deforming the can body. It is to be understood, however, in accordance with this invention it is feasible that the external threads 34 could be separately formed, for example on a sleeve member which is secured to the body 14.

At this time it is pointed out that the lower closure unit 15 could be integrally formed with the body 14 or could be separately formed and secured thereto in any desired manner including by way of a double seam. It is, however, necessary that any seam be recessed so as not to interfere with the movement of the pump member 24 into telescoped engagement with the can body 14.

It is also pointed out here that it is desirable that a seal be generally effected between the threads 30 and 34. Accordingly, either the pump body 28 or the exterior of the can body 14 having the threads 34 thereon should be formed of a suitable material which has the necessary sealing characteristics. Beneficially, the pump member 24 may be formed of a resilient plastics material which will tightly engage the threads 34 and form a seal therewith while permitting the necessary freedom of rotation of the pump member 24 relative to the can body 14.

The lower closure unit 15 also carries a oneway inlet valve 36 which may be of a similar or identical construction to the inlet valve 32. Actually, the inlet valve 36 functions as a discharge valve for the pump unit 22.

It will be seen that the pump member 24, in combination with the lower closure unit 15, defines a pump chamber 38. The pump chamber 38, when the pump member 24 is in its fully retracted position, contains air at substantially atmospheric pressure. Then, when the pump member 24 is screwed up onto the lower part of the can body 14, the volume of the chamber 38 is reduced with the result that the air within the chamber 38 is compressed and, when it reaches a pressure above the pressure within the can 12, the inlet valve 36 will open and the air will enter into the bottom of the can 12 so as to raise the pressure within the can 12.

When the pump member 24 is unscrewed relative to the can 12, the chamber 38 increases in volume, as shown in FIG. 3, with the result that atmospheric air enters into the chamber 38 through the inlet valve 32.

It is to be understood that the pump unit 22 may be actuated several times in sequence in order to obtain the necessary pressure within the can 12.

It is to be understood that in order for there to be a proper dispensing of a product, such as the product 40, stored within the can 12, the internal pressure of the can must exceed a predetermined minimum. Accordingly, the dispensing valve mechanism 20 is specially constructed so as to prevent dispensing of the product 40 when the pressure is below the predetermined minimum.

Referring now most particularly to FIG. 5, it will be seen that the valve cup 18 has fixedly secured to the underside thereof in sealed relation thereto a first valve housing 42. A second valve housing 44 is secured to the underside of the valve housing 42 in sealed relation. The valve housing 44 carries at its lower end a product tube 45 which extends down into the bottom of the can 12. At this time it is pointed out that the two separate housings 42, 44 could feasible be of a unitary construction.

The valve housing 44 carries a shutoff valve member 46 which is urged by a spring 48 to seat on a bottom wall 50 of the valve housing 44 and to close an inlet passage 52 formed therein. Thus, when the pressure within the can 12 is insufficient to unseat the valve member 46, no product can enter into the valve housing 42 for dispensing.

Between the valve housings 42 and 44 there is a passage 54 which is normally closed by a check valve 56 when the valve member 46 is in its product passing position. Thus, even though the pressure within the product tube 46 may be sufficient to move the shutoff valve 46 to an open position, flow of the product into the valve housing 42 is normally prevented by the check valve member 56.

A conventional combination nozzle and actuator 58 extends up into the valve cup 18 from the valve housing 42 as is clearly shown in FIGS. 2 and 5. The nozzle 58 is urged to an upper position by a spring 60 and is prevented from moving out of the housing 42 by a flange 62. An actuator rod or the equivalent 64 extends down from the nozzle 58 through the passage 54 for engaging and unseating the check valve member 56 when the nozzle 58 is depressed against the upward urging of the spring 60. When the check valve member 56 is unseated, and the pressure within the can 12 is sufficient to unseat the shutoff valve member 46 the product 40 will be directed through the nozzle 58 in the normal manner.

When the shutoff valve member 46 closes the valve mechanism 20 to the reception of the product 40, this is a signal to the user that the pressure within the can 12 must be increased, and therefore the pump unit 22 is again actuated so as to deliver air into the can 12 so as again to pressurize the interior of the can 12 to the necessary dispensing pressure.

While the air has been illustrated as being in direct contact with the product 40 and as passing through the product 40 so as to be disposed in the upper part of the can, it is pointed out here that it is also feasible that the product be stored within a bag which is sealed relative to the dispensing valve mechanism 20 as opposed to the use of the tube 45.

Although only a preferred embodiment of the aerosol container has been specifically illustrated and described herein, it is to be understood that minor variations may be made in both the pump unit and the dispensing valve mechanism without departing from the spirit and scope of the invention as defined by the appended claims.

We claim:

1. An aerosol container comprising a container body having a lower closure unit and an upper closure unit, said lower closure unit carrying an inlet valve and said upper closure unit carrying a dispensing valve mechanism, and a pump unit carried by a lower part of said container body and forming a lower extension of said container body, said pump unit in combination with said lower closure unit forming a pump chamber, an inlet valve carried by said pump unit, and connecting means between said pump unit and said container body for selectively varying the volume of said chamber to first draw air into said chamber and then pump air from said chamber into said container body for internally pressurizing said container, said dispensing valve mechanism including automatic shutoff means responsive to low pressure in said container, said shutoff means including a supply passage and a spring loaded disc valve member for closing said supply passage in response to low pressure in said supply passage, and a dispensing valve member in said supply passage, said disc valve member being disposed in said supply passage upstream of said dispensing valve member.

2. An aerosol container according to claim 1 wherein said dispensing valve member is a check valve movable to a closed position by said spring loaded disc valve member for normally preventing dispensing when said spring loaded disc valve member is in an open position.

3. For use in an aerosol container, a dispensing valve mechanism comprising a supply passage for receiving a product to be dispensed under pressure, a dispensing valve member in said supply passage for selectively controlling the dispensing of a product, and automatic shutoff means responsive to low pressure in said supply passage, said automatic shutoff means being disposed in said supply passage upstream of said dispensing valve member and including a spring loaded disc valve member for closing said supply passage to said dispensing valve member in response to low pressure in said supply passage.

4. A dispensing valve mechanism according to claim 3 wherein said dispensing valve member is a check valve carried by said spring loaded disc valve member and is movable to a closed position by said spring loaded disc valve member for normally preventing dispensing when said spring loaded disc valve member is in an open position.

5. A dispensing valve mechanism according to claim 4 wherein said dispensing valve mechanism includes a combination nozzle and actuator for unseating said check valve member.

* * * * *